US009752849B2

(12) United States Patent
Anderson

(10) Patent No.: US 9,752,849 B2
(45) Date of Patent: Sep. 5, 2017

(54) RECOIL-INHIBITING GRIPS FOR FIREARMS

(71) Applicant: Crimson Trace Corporation, Wilsonville, OR (US)

(72) Inventor: Danny Homem de Mello Anderson, Wilsonville, OR (US)

(73) Assignee: Crimson Trace Corporation, Wilsonville, OR (US)

( * ) Notice: Subject to any disclaimer, the term of this patent is extended or adjusted under 35 U.S.C. 154(b) by 20 days.

(21) Appl. No.: 15/046,304

(22) Filed: Feb. 17, 2016

(65) Prior Publication Data

US 2016/0349002 A1 Dec. 1, 2016

Related U.S. Application Data

(60) Provisional application No. 62/166,516, filed on May 26, 2015.

(51) Int. Cl.

| | |
|---|---|
| ***F41C 23/00*** | (2006.01) |
| ***F41C 23/10*** | (2006.01) |
| ***F41C 3/00*** | (2006.01) |
| ***F41G 1/35*** | (2006.01) |
| ***F41C 23/08*** | (2006.01) |

(52) U.S. Cl.

CPC ..... *F41C 23/10* (2013.01); *F41C 3/00* (2013.01); *F41C 23/08* (2013.01); *F41G 1/35* (2013.01)

(58) Field of Classification Search

CPC ..... F41C 23/10; F41C 23/06
USPC ..... 42/74, 71.02, 114
See application file for complete search history.

(56) References Cited

U.S. PATENT DOCUMENTS

| | | | | |
|---|---|---|---|---|
| 4,242,824 A * | 1/1981 | Pachmayr | F41C 23/10 | 42/71.02 |
| 5,231,237 A * | 7/1993 | Cupp | F41C 23/10 | 42/71.02 |
| 5,435,091 A * | 7/1995 | Toole | F41G 1/345 | 362/114 |
| 7,805,876 B1 * | 10/2010 | Danielson | F41C 23/10 | 362/114 |
| 8,662,694 B1 * | 3/2014 | Izumi | F41G 1/34 | 362/109 |
| 2013/0185982 A1 * | 7/2013 | Hilbourne | F41G 1/35 | 42/117 |

* cited by examiner

*Primary Examiner* — J. Woodrow Eldred
(74) *Attorney, Agent, or Firm* — Schwabe, Williamson & Wyatt, P.C.

(57) ABSTRACT

Disclosed are recoil-inhibiting grips for handguns that minimize recoil without sacrificing aiming accuracy. The grips may provide both recoil inhibition and grip stability by incorporating a vibration-damping elastomeric strategically positioned in only the back surface of a handgun grip (e.g., facing the palm). The elastomeric insert may be incorporated in the top section of the rear surface of the grip, where the bulk of the recoil force meets the user's palm.

15 Claims, 3 Drawing Sheets

RECOIL-INHIBITING GRIPS FOR FIREARMS

CROSS-REFERENCE TO RELATED APPLICATION

This Application claims the priority benefit of the earlier filing date of U.S. Provisional Application No. 62/166,516, filed May 26, 2015, which is incorporated herein by reference in its entirety.

TECHNICAL FIELD

Embodiments relate firearms and, more specifically, to firearm grips and materials that counteract recoil in firearms with grips, such as handgun grips.

BACKGROUND

Recoil (often called knockback, kickback or simply kick) is the backward momentum of a firearm when the firearm is discharged. Recoil is the physical manifestation of the momentum opposing the forward momentum of the projectile and exhaust gases (ejecta), according to the conservation of momentum (Newton's third law). This change in momentum of the ejecta results in a force that must be compensated for by the shooter. In order to bring the gun to a halt, a forward counter-recoil force must be applied to the firearm. Generally, the counter-recoil force applied by the shooter is smaller than the recoil force, and is applied over a time period that is longer than the time that the recoil force is being applied (e.g., the time during which the ejecta are still in the barrel of the gun). This imbalance of forces causes the gun to move backward until it is motionless, and may result in the gun kicking upward as the momentum is transferred to angular momentum around a joint of a shooter. For small arms, the way in which the shooter perceives the recoil, or kick, can have a significant impact on the shooter's experience and performance.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
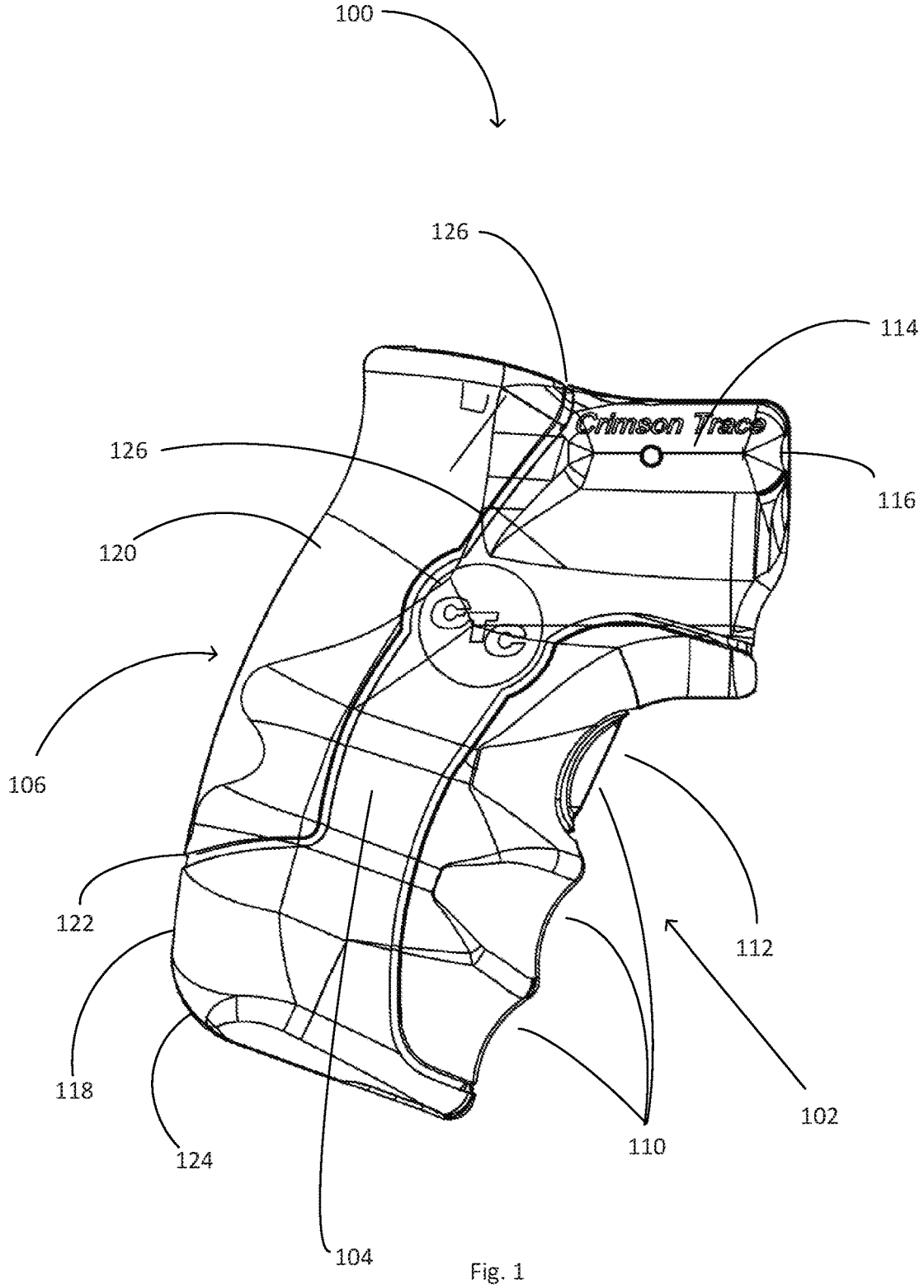
FIG. 1 shows a side view of one example of a recoil-inhibiting grip for a firearm, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Disclosed herein in various embodiments are recoil inhibiting grips for handguns that minimize recoil without sacrificing aiming accuracy. Various elastomeric materials previously have been used in handgun grips to help absorb recoil. However, elastomeric materials that are sufficiently yielding to absorb recoil forces tend to also yield to the pressure of a user's hand on the grip. Thus, although these materials may improve recoil during firing of the handgun, they also may interfere with aiming accuracy, as the stability of the user's grasp of the grip may be compromised.

Disclosed herein are grips for firearms that provide recoil inhibition while also maintaining grip stability. In various embodiments, a typical, firm grip material may be used with an elastomeric upper back strap section strategically positioned in only the back surface of a handgun grip typically in proximity to the firearm user's palm (e.g., facing the palm). For example, in some embodiments, the elastomer may be incorporated only in the upper portion, such as top section, of the rear surface of the grip (also known as the back strap of the grip), where the bulk of the recoil force meets the user's palm. In various embodiments, the elastomeric material may be positioned only at the point of the grip where the force of the recoil exerts the most pressure on the hand of the user when the handgun is fired, while the majority of the grip surface may be formed from a firmer material that enables the user to maintain a stable grip on the handgun during use.

Thus, disclosed in various embodiments are recoil-inhibiting grips for a firearm that reduce recoil without sacrificing grip stability and/or aiming accuracy. In various embodiments, the grips may include a front strap, a right side grip portion, a left side grip portion, and a back strap. In various embodiments, the back strap may include a top section and a bottom section that are composed of separate and distinct materials. In various embodiments, the back strap may include a top section and a bottom section that are composed of the same material. In various embodiments, the front strap, the right side grip portion and the left side grip portion may be constructed of one or more rigid materials, for example rigid plastic or polycarbonate, mother of pearl, wood, metal, or combinations thereof, including inlayed and/or filigree materials, for example G10, nylon, polyurethane, and polycarbonate. In various embodiments, the front strap, the right side grip portion, the left side grip portion, and the bottom section of the back strap may be constructed of one or more rigid materials, for example rigid plastic or polycarbonate, mother of pearl, wood, metal, or combinations thereof, including inlayed and/or filigree materials, for example G10, nylon, polyurethane, and polycarbonate. In some embodiments, the bottom section of the back strap may be formed from contiguous material forming the left and/or right side grip portions.

In various embodiments, the top section of the back strap may be constructed of a kinetic energy-absorbing material that is mechanically coupled to right side grip portion and the left side grip portion, for example the upper section of the back strap may connect the left side grip to the right side grip. In various embodiments, the mechanical coupling may be such that the grip may be splayed open with the left and right side grip portions disposed on either side of the top section of the back strap, for example to access or install electronics that may be housed within the grip, such as a laser sight and associated electronic components and/or a battery. In various embodiments, the resulting assembly may form a "clam shell" like structure that may be fit around the handle portion of the gun frame, closing at the front strap, for example. In some embodiments, the grips are for handguns. In other embodiments, the grips are for long guns and/or shotguns, such as riot type shotguns, having a "pistol" type grip.

In various embodiments of the recoil-inhibiting grip, the top section of the back strap may include an interior surface and an exterior surface. In certain embodiments, the grip may include a plurality of cavities between the interior surface of the top section of the back strap and a firearm frame, for example when attached to a firearm frame. In certain embodiments, the interior surface of the backstrap may include a plurality of ribs disposed thereupon, for example separating the interior surface into a plurality of cavities. In some embodiments, these cavities may increase the softness (e.g., decrease the effective durometer) of the grip in the region where they are incorporated. In some embodiments, the plurality of ribs on the interior surface of the top section of the back strap may include at least a portion, such as some or all, that are vertically oriented (e.g., substantially aligned with the vertical axis of the grip and/or substantially perpendicular to the longitudinal axis of the barrel). In particular embodiments, the plurality of ribs on the interior surface of the top section of the back strap may include at least a portion, such as some or all, that are horizontally oriented. In some embodiments, the plurality of ribs on the interior surface of the top section of the back strap also may include a portion that are vertically oriented and a portion that are that are horizontally oriented. In certain embodiments, the horizontally oriented ribs may be disposed between the vertically oriented ribs, and in certain examples the horizontally oriented ribs may be offset with respect to each other.

In specific, non-limiting examples, the interior surface of the top section of the back strap may include a plurality of vertical ribs spanning the length of the top portion of the grip, and short horizontal ribs that may run between and interconnect adjacent vertical ribs. In some examples, the short horizontal ribs may be offset or staggered with respect to each other. In particular examples, flexing or splaying the grip into an open position (e.g., with the left side portion and right side portion in substantially the same plane) may stretch the vertical ribs apart. In even more particular examples, the short horizontal ribs may serve to limit the separation of the vertical ribs when the grip is flexed into the open position. In yet more particular examples, the horizontal ribs may serve as cross-ties between the vertical ribs, and the vertical ribs and short horizontal cross ties may form a modified "honeycomb" structure when the grip is flexed into the open (e.g., substantially planar) position. In various embodiments, the size, shape, and orientation of the vertical and/or horizontal ribs may be varied in order to achieve a desired degree of recoil inhibition, durometer, flexibility, or other properties.

In various embodiments, the recoil-inhibiting grip may include a laser sight housing integrated into at least one of the right side grip portion or the left side grip portion. In various embodiments, the housing may include a laser sight coupled thereto or otherwise housed within the laser sight housing. In various embodiments, the electronic controls for the laser sight may be housed in or on the interior surface of the grip, such as on the right side grip portion or the left side grip portion. In certain embodiments, the recoil-inhibiting grip may include an activation switch for the laser sight, for example a switch, button, pressure sensor, or heat sensor that senses the presence of a finger or other part of the hand on the grip. In various embodiments, the activation switch may be disposed on the front strap, such as where the fingers of a user would rest while gripping the firearm.

Thus, in various embodiments, the recoil-inhibiting grips of the present disclosure may include a recoil-inhibiting portion of the back strap that is formed from a material that absorbs kinetic energy and prevents recoil when the handgun is fired, and one or more comparatively more rigid portions of the grip (particularly the left and right side portions, front strap, and laser sight housing portion) that promote a secure grip and accurate aiming. In some embodiments the energy absorbing material extends to the bottom of the back strap. In some embodiments, the energy absorbing material extends only partially down the back strap and the bottom of the back strap is formed from a different material.

Also disclosed in various embodiments are firearms that include disclosed recoil-inhibiting grip. In embodiments, the firearm may be a handgun, a long gun, or a shot gun having a pistol grip.

As disclosed herein, a recoil-inhibiting grip may include a top section of the back strap that is composed of a kinetic energy-absorbing material. In various embodiments, this top section may be composed of any of a variety of materials, and may be selected based on the energy-absorbing properties as well as function within the context of a firearm. For example, in various embodiments, materials may be selected that have chemical resistance, such as resistance to break down or visual blemish by solvents and lubricants typically used for cleaning and maintenance of firearms. In addition, in various embodiments, materials may be chosen that may maintain their shape and integrity in a variety of conditions in which firearms are used. Specific, non-limiting examples of suitable materials include polymeric materials, which may be formed into various shapes, such as those of a disclosed recoil-inhibition grip. Elastomeric polymers, such as thermoplastic polymers may be particularly useful the grips disclosed herein and may be obtained from commercial sources. In specific, non-limiting examples, for example, styrenic block copolymers (TPE-s), thermoplastic olefins (TPE-o), elastomeric alloys (TPE-v or TPV), thermoplastic polyurethanes (TPU), thermoplastic copolyester and thermoplastic polyamides may be selected, and may be obtained from a variety of vendors. In one specific, non-limiting example, Versaflex™ thermoplastic polymers available from PolyOne™ are particularly suited for use in a recoil-inhibiting hand grip. In specific, non-limiting examples, the thermoplastic polymer may be Versaflex™ VDT 5120-40N, Versaflex™ VDT 5120-50N or Versaflex™ VDT 4132. Other suitable elastomers include those available from Sorbothane®, such as Sorbothane® 30, 50, and 70. In various embodiments, the top portion of the back strap may include an elastomer, such as an elastomeric polymer, for example a thermoplastic polymer. In specific embodiments, the elastomer may have a tensile stress of about 60 psi to about 300 psi at 100% strain, such as about 75 psi+/−5 psi at 100% strain. In various embodiments, the elastomer may have a tensile stress of about 100 psi to about 450 psi at 300% strain, such as about 138 psi+/−5 psi at 300% strain. In various embodiments, the elastomer may have a tensile strength (yield) of about 385-895 psi. In various embodiments, the elastomer may have a tear strength (break) of about 60 lbf/in to about 200 lbf/in, such as about 80 lbf/in+/−5 lbf/in. In embodiments, the elastomer has an elongation of about 775% to about 950%. In various embodiments, the elastomer may have a compression set of about 10% to about 25%, such as about 12%+/−5%. In various embodiments, embodiments, the elastomer may have a durometer hardness of about 30-60 Shore A, such as about 32-42 Shore A. In some examples, the polymer may be a thermoplastic elastomer.

FIG. 1 shows a recoil-inhibiting grip 100 in accordance with various embodiments. Grip 100 includes front strap 102, right side grip portion 104 and left side grip portion (not visible in this view), and back strap 106. In the embodiment shown, front strap 102 includes finger recesses 110 and laser sight activation switch 112. As shown in this view, right side portion 104 includes laser sight housing 114 and laser aperture 116. Although the laser sight is shown on the right grip portion of the grip, it is equally applicable to the left grip portion, for example as a mirror image.

Back strap 106 includes bottom section 118 and top section 120. Bottom section 118 extends from lower seam 122 approximately to bottom 124. Top section 120 of back strap 106 extends from lower/upper section seam 122 to upper seam 126 and meets grip side portions 104 at a side seam, which is demarked with the thick black line. In embodiments, top section 120 of back strap 106 is constructed of a kinetic energy-absorbing material that is mechanically coupled to right side grip portion 104 and the left side grip portion (not shown). For example, top section 120 of back strap 106 connects the left side grip and right side grip 104. The mechanical coupling is such that grip 100 may be splayed open with the left and right side grip portions disposed on either side of top section 120 of the back strap 106. The resulting assembly may form a "clam shell" like structure that can be fit around the handle portion of the gun frame closing at front strap 102, for example.

Figure 2A:
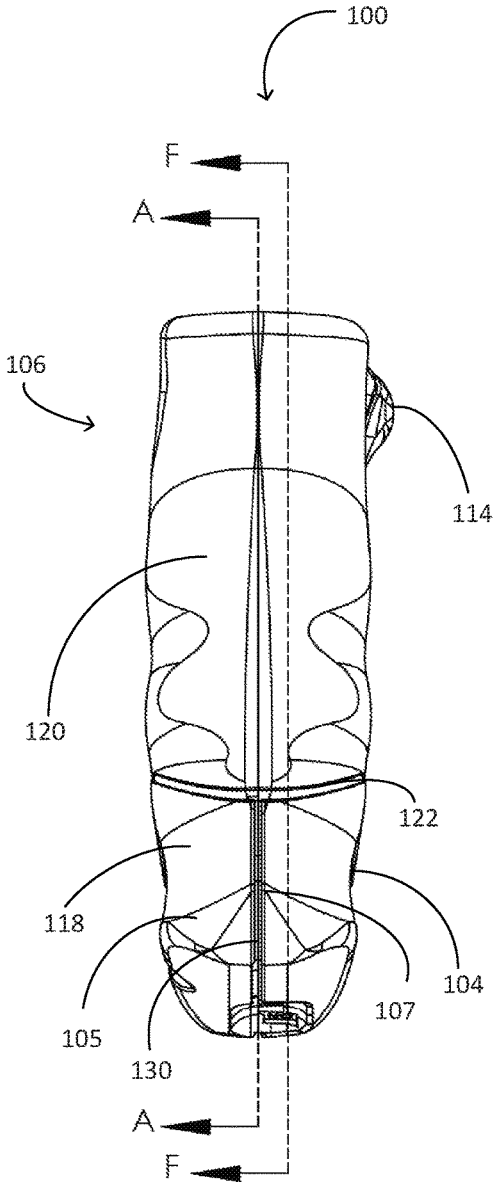
FIG. 2A shows an end on view of one example of a recoil-inhibiting grip for a firearm as rotated 90° from FIG. 1, in accordance with various embodiments.
Figure 2B:
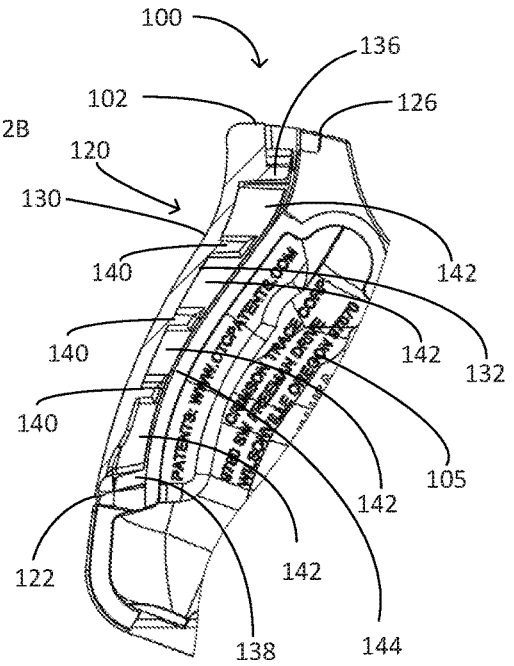
FIG. 2B shows a slice normal to plane A-A of the view shown in FIG. 2A, in accordance with various embodiments.
Figure 2C:
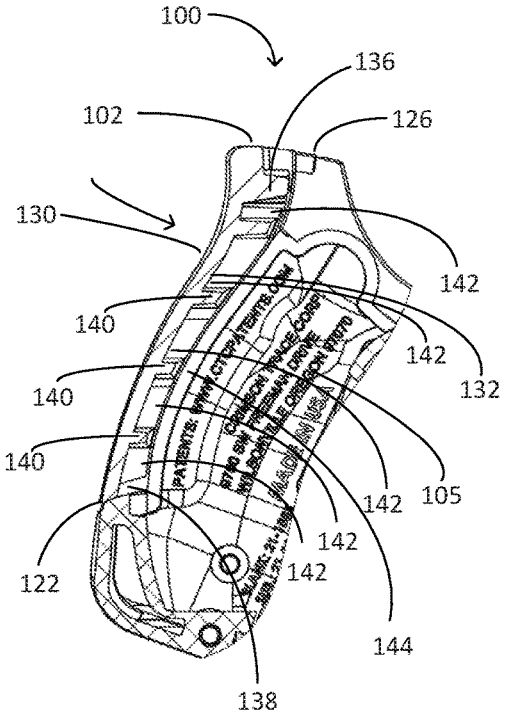
FIG. 2C shows a slice normal to plane F-F of the view shown in FIG. 2A, in accordance with various embodiments.

FIG. 2A shows a recoil-inhibiting grip 100 as viewed from the back, rotated 90° counter clockwise about the vertical axis from the view in FIG. 1, in accordance with various embodiments. As shown in FIG. 2, back strap 106 includes top section 120 and bottom section 118, separated by lower seam 122. As can be seen from this view, bottom section 118 of back strap 106 is an extension of right side portion 104 and left side portion 105, which meet together at seam 130. Because top section 120 of back strap 106 is single piece, there is no central seam in the top section 120, and top section 120 is mechanically coupled to right side portion 104 and left side portion 105, holding the three pieces together as a single assembly. This view also shows laser sight housing 114 extending away from right side portion 104. FIG. 2A also includes cut planes A-A and F-F extending out from the page. The planes are represented as FIGS. 2B and 2C, respectively.

Turning to FIGS. 2B and 2C, these drawings show the internal structures present in one example of a disclosed recoil-inhibiting hand grip, in accordance with various embodiments. FIGS. 2B and 2C show top section 120 of back strap 106 and left side grip portion 105. Top section 120 extends between lower seam 122 and upper seam 126. Top section 120 includes outer surface 130 and inner surface 132. Top section 120 further includes upper flange 136 and lower flange 138. Flanges 136 and 138 sit snuggly against the surface of right side portion 104 and left side portion 105 and demark the upper and lower boundaries of top section 120 at seams 122 and 126. Inner surface 132 includes a plurality of horizontal ribs 140, which help delineate internal cavities 142. Horizontal ribs 140 rest against inner wall 144 of right and left side portions 104, 105. Alternation of ribs 140 and cavities 142 may help to create zones for grip deformation which helps to absorb recoil shock. For example, a solid upper back strap section would likely not have the same ability to absorb shock as a ribbed one.

Figure 3A:
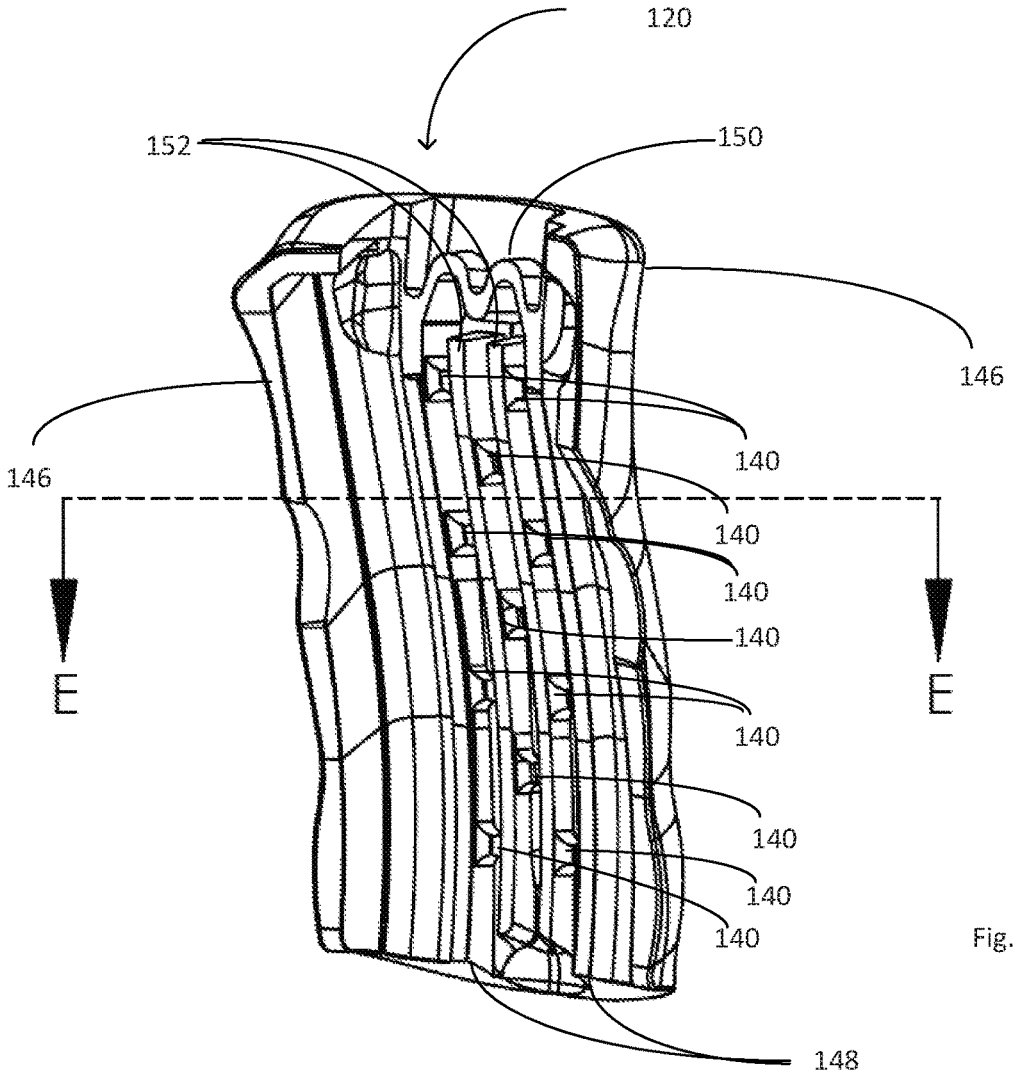
FIG. 3A shows a front facing view of one example of a recoil-inhibiting grip upper portion, in accordance with various embodiments.

FIG. 3A shows a front view of an embodiment of top section 120, with side portions 104, 105 stripped away. Top section 120 includes side walls 146 and interior walls 148. Side walls 146 extend slightly over side portions 104, 105 (not shown in this view) when assembled, and are capped by cap 150. Interior walls 148 nestle against inner wall 144 (not shown in this view). Disposed between interior walls 148 are a plurality of vertical ribs 152. While this view shows two ribs, the exact number may vary based on application and cushioning preference. FIG. 3A further shows horizontal ribs 140 disposed between vertical ribs 152, the exact number of which may be selected by application and user preference. FIG. 3A further includes slice plane E-E which is shown in FIG. 3B.

Figure 3B:
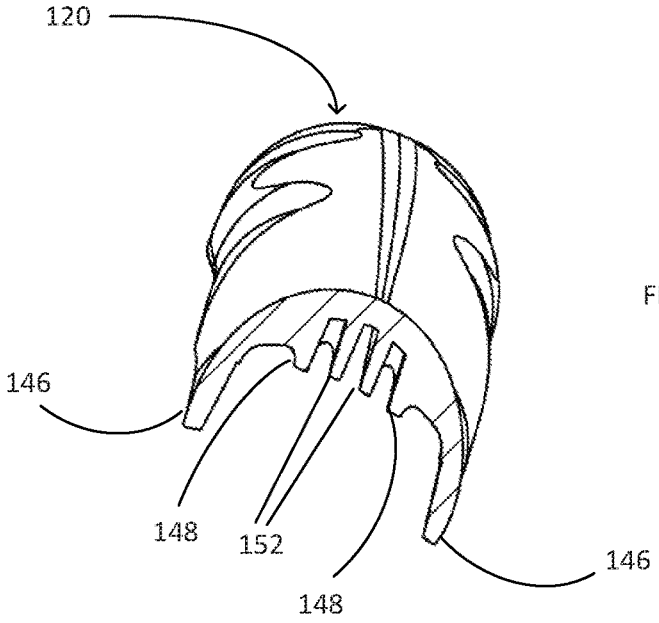
FIG. 3B shows a slice normal to plane E-E of the view shown in FIG. 3A, in accordance with various embodiments.

FIG. 3B shows a horizontal slice though top section 120. Outer walls 146, inner walls 148, and vertical ribs 152 can be seen in this view.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A recoil-inhibiting grip for a firearm, comprising:

a front strap;

a right side grip portion;

a left side grip portion; and a back strap, including a top section and a bottom section, wherein the right side grip portion, the left side grip portion, and the bottom section of the back strap consist essentially of one or more rigid materials; and wherein the top section of the back strap is constructed of a kinetic energy-absorbing material, wherein the top section of the back strap is mechanically coupled to right side grip portion and the left side grip portion.

2. The recoil-inhibiting grip of claim 1, where the top section of the back strap comprises an interior surface and an exterior surface and wherein there are a plurality of cavities between the interior surface of the top section of the back strap and the firearm frame.

3. The recoil-inhibiting grip of claim 1, wherein the inner surface comprises a plurality of ribs disposed thereupon.

4. The recoil-inhibiting grip of claim 3, wherein at least a portion of the ribs are vertically oriented.

5. The recoil-inhibiting grip of claim 3, wherein at least a portion of the ribs are horizontally oriented.

6. The recoil-inhibiting grip of claim 5, wherein the horizontally oriented ribs are deposed between vertically oriented ribs.

7. The recoil-inhibiting grip of claim 1, wherein the top section of the back strap connects the left side grip and the right side grip.

8. The recoil-inhibiting grip of claim 1, wherein the top section of the back strap, comprises a polymer.

9. The recoil-inhibiting grip of claim 8, wherein the polymer comprises a thermoplastic elastomer.

10. The recoil-inhibiting grip of claim 1, further comprising a laser sight housing integrated into at least one of the right side grip portion or the left side grip portion.

11. The recoil-inhibiting grip of claim 10, wherein right side grip portion or the left side grip portion of have an interior surface and an exterior surface and wherein the electronic controls for the laser sight are housed on the interior surface of the right side grip portion or the left side grip portion.

12. The recoil-inhibiting grip of claim 11, further comprising an activation sensor for the laser sight.

13. The recoil-inhibiting grip of claim 12, wherein the activation sensor is disposed on the front strap.

14. A firearm comprising the recoil-inhibiting grip of claim 1.

15. The firearm of claim 14, wherein the fire arm is a handgun, or a long gun or a shot gun having a pistol grip.

* * * * *